US009181655B2

(12) United States Patent
Gustavsson et al.

(10) Patent No.: US 9,181,655 B2
(45) Date of Patent: Nov. 10, 2015

(54) EXTENDED NIP ROLL, AN EXTENDED NIP PRESS MAKING USE OF THE EXTENDED NIP ROLL, A PAPERMAKING MACHINE AND A METHOD OF OPERATING AN EXTENDED NIP PRESS

(71) Applicant: Valmet AB, Sundsvall (SE)

(72) Inventors: Tord Gustavsson, Borgvik (SE); Goeran Ekstroem, Vaesa (SE); Jan Paulsson, Kil (SE); Karl-Johan Tolfsson, Forshaga (SE)

(73) Assignee: Valmet AB, Sundsvall (SE)

( * ) Notice: Subject to any disclaimer, the term of this patent is extended or adjusted under 35 U.S.C. 154(b) by 0 days.

(21) Appl. No.: 14/391,152

(22) PCT Filed: Mar. 12, 2013

(86) PCT No.: PCT/SE2013/050227

§ 371 (c)(1),
(2) Date: Oct. 7, 2014

(87) PCT Pub. No.: WO2013/158010

PCT Pub. Date: Oct. 24, 2013

(65) Prior Publication Data

US 2015/0060000 A1 Mar. 5, 2015

(30) Foreign Application Priority Data

Apr. 19, 2012 (SE) ..... 1250393
Sep. 6, 2012 (SE) ..... 1251000

(51) Int. Cl.
*D21G 1/00* (2006.01)
*D21F 3/02* (2006.01)
*D21F 11/14* (2006.01)

(52) U.S. Cl.
CPC ..... *D21G 1/006* (2013.01); *D21F 3/0218* (2013.01); *D21F 3/0281* (2013.01); *D21F 11/14* (2013.01)

(58) Field of Classification Search
USPC ..... 162/358.3
IPC ..... D21G 1/00; D21F 3/06; B32B 5/02
See application file for complete search history.

(56) References Cited

U.S. PATENT DOCUMENTS
3,981,084 A 9/1976 Sobota
4,055,461 A 10/1977 Turunen
(Continued)

FOREIGN PATENT DOCUMENTS
DE 10229155 A1 1/2004
EP 1304215 A1 4/2003
(Continued)

OTHER PUBLICATIONS
International Searching Authority, International Search Report for International Application No. PCT/SE2013/050227, Jul. 5, 2013, 4 pages, Swedish Patent and Registration Office, Stockholm.
(Continued)

*Primary Examiner* — Mark Halpern
(74) *Attorney, Agent, or Firm* — Alston & Bird LLP

(57) ABSTRACT

The invention relates to an extended nip roll (5) capable of forming a press nip (N) with a counter roll (7) which press nip (N) has an extension in a machine direction when the extended nip roll (5) cooperates with the counter roll (7). The extended nip roll (5) comprises a flexible jacket; an elastic press body (13) arranged inside the flexible jacket. The top side (14) of the press body (13) is beveled in such a way that, in the machine direction, a working surface (15) of the top side has a downstream end (16) which, in the machine direction, is followed by an exit side surface (17) that diverges from the interior surface (11) of the flexible jacket (10). The press body (13) further has at least a first and a second internal pressure chamber (18, 19). The pressure chambers (18, 19) can be pressurized such that the press body (13) expands. The first internal pressure (18) chamber has an extension in the machine direction that does not extend beyond the working surface (15) and the second internal pressure chamber (19) is located downstream of the first internal pressure chamber (18) and has an extension in the machine direction beyond the downstream end (16) of the working surface (15). The working surface (15) and the exit side surface (17) are made of a material that has a higher shore A hardness than the material in the rest of the press body (13). The invention also relates to an extended nip press and a paper machine in which the extended nip roll is used. The invention further relates to a method of operating the extended nip press.

20 Claims, 10 Drawing Sheets

(56) References Cited

U.S. PATENT DOCUMENTS

| | | | |
|---|---|---|---|
| 4,144,124 | A | 3/1979 | Turunen et al. |
| 4,225,382 | A | 9/1980 | Kearney et al. |
| 4,309,246 | A | 1/1982 | Hulit et al. |
| 4,507,173 | A | 3/1985 | Klowak et al. |
| 4,625,376 | A | 12/1986 | Schiel et al. |
| 5,098,523 | A | 3/1992 | Ilmarinen et al. |
| 5,126,015 | A | 6/1992 | Pounder |
| 5,393,384 | A | 2/1995 | Steiner et al. |
| 5,670,023 | A | 9/1997 | Steiner et al. |
| 5,738,760 | A | 4/1998 | Svanqvist et al. |
| 5,741,402 | A | 4/1998 | Trokhan et al. |
| 5,875,990 | A | 3/1999 | Svanqvist et al. |
| 5,901,918 | A | 5/1999 | Klerelid et al. |
| 5,904,813 | A | 5/1999 | Bengtsson et al. |
| 6,030,500 | A | 2/2000 | Haraldsson et al. |
| 6,036,909 | A | 3/2000 | Baum |
| 6,165,324 | A | 12/2000 | Linden |
| 6,176,898 | B1 | 1/2001 | Courtney et al. |
| 6,189,442 | B1 | 2/2001 | Honkalampi et al. |
| 6,395,136 | B1 | 5/2002 | Andersson et al. |
| 6,547,924 | B2 | 4/2003 | Klerelid et al. |
| 6,790,315 | B2 | 9/2004 | Klerelid |
| 7,527,708 | B2 | 5/2009 | Gustavsson |
| 7,662,260 | B2 | 2/2010 | Thoroe-Scherb et al. |
| 7,811,418 | B2 | 10/2010 | Klerelid et al. |
| 8,002,950 | B2 | 8/2011 | Quigley |
| 8,911,594 | B2 | 12/2014 | Gustavsson |
| 9,057,157 | B2 | 6/2015 | Gustavsson |
| 2001/0035103 | A1 | 11/2001 | Scherb et al. |
| 2002/0052160 | A1 | 5/2002 | Hill et al. |
| 2008/0283208 | A1 | 11/2008 | Norrman et al. |
| 2009/0173465 | A1 | 7/2009 | Gustavsson |
| 2014/0284012 | A1 | 9/2014 | Gustavsson |
| 2015/0060001 | A1 | 3/2015 | Gustavsson |

FOREIGN PATENT DOCUMENTS

| | | | |
|---|---|---|---|
| EP | 1273701 | B1 | 4/2005 |
| EP | 2085513 | B1 | 9/2011 |
| EP | 2602387 | A1 | 6/2013 |
| MX | PA/a/2006003015 | A | 12/2006 |
| WO | WO 99/40255 | A1 | 8/1999 |
| WO | WO 99/45195 | A1 | 9/1999 |
| WO | WO 00/79043 | A1 | 12/2000 |
| WO | WO 02/50372 | A1 | 6/2002 |
| WO | WO 2005/038129 | A1 | 4/2005 |
| WO | WO 2005/038130 | A1 | 4/2005 |
| WO | WO 2010/028923 | A1 | 3/2010 |
| WO | WO 2013/015739 | A1 | 1/2013 |
| WO | WO 2013/085456 | A1 | 6/2013 |

OTHER PUBLICATIONS

International Searching Authority, International Search Report for Internationl Application No. PCT/SE2012/051340, mailed Mar. 18, 2013, 5 pages, Swedish Patent and Registration Office, Sweden.

International Searching Authority, Written Opinion for International Application No. PCT/SE2012/051340, mailed Mar. 18, 2013, 5 pages, Swedish Patent and Registration Office, Sweden.

European Patent Office, Extended European Search Report for Application No. 13777478.2, Mar. 3, 2015, 6 pages, Germany.

EXTENDED NIP ROLL, AN EXTENDED NIP PRESS MAKING USE OF THE EXTENDED NIP ROLL, A PAPERMAKING MACHINE AND A METHOD OF OPERATING AN EXTENDED NIP PRESS

CROSS REFERENCE TO RELATED APPLICATIONS

This application is a National Stage Application, filed under 35 U.S.C. §371, of International Application No. PCT/SE2013/050227, filed Mar. 12, 2013, which claims priority to Swedish Application No. 1250393-4, filed Apr. 19, 2012 and Swedish Application No. 1251000-4, filed Sep. 6, 2012, the contents of all of which as are hereby incorporated by reference in their entirety.

BACKGROUND

1. Related Field

The invention relates to an extended nip roll, to an extended nip press that comprises the inventive extended nip roll and to a paper making machine comprising such an extended nip press. The invention also relates to a method of operating the inventive extended nip wherein a wet paper web is passed through the extended nip.

2. Description of Related Art

The invention relates to the field of extended nip presses used in paper making machines. In a paper making machine, an extended nip press is normally used for pressing water out of a newly formed wet fibrous web but an extended nip may also be used for other purposes in a paper making machine, e.g. calendering. Although extended nip presses were first introduced for heavy grades such as paperboard, they later come to be used also for lighter grades such as printing paper. In recent years, such presses have also been used in machines for making tissue paper. In such machines, the extended nip press is often formed by an extended nip roll and a Yankee drying cylinder that acts as a counter roll for the extended nip roll. An extended nip press is typically formed by an extended nip roll that comprises a rigid shoe with a concave surface. The rigid shoe of such an extended nip roll can be made of a material such as, for example, steel or aluminum. U.S. Pat. No. 7,527,708 discloses how an extended nip can be formed by means of a device that does not use a steel shoe but instead a support body which is elastically deformable. The support body disclosed in that document has internal pressure chambers that can be connected to a pressure medium source.

Generally, it is desirable that the pressure in the nip of an extended nip press rises from the beginning of the nip to reach a peak at the end of the nip. Such a pressure profile is advantageous since it reduces re-wetting of the paper web when the web exits from the press nip. In U.S. Pat. No. 7,527,708, it is suggested that different pressure chambers are set under different pressures such that a pressure curve describing a stepped course is obtained.

It is an object of the present invention to provide an extended nip press that is designed in such a way that a suitable pressure profile is obtained.

Another object of the invention is to provide an extended nip press in which the lubrication functions in a reliable way.

BRIEF SUMMARY

The invention relates to an extended nip roll capable of forming a press nip with a counter roll which press nip has an extension in a machine direction when the extended nip roll cooperates with the counter roll. The inventive extended nip roll comprises; a flexible jacket with an interior surface and an exterior surface and a press body arranged inside the flexible jacket. The press body is elastically deformable and it has a top side that faces the interior surface of the flexible jacket. The top side of the press body is beveled in such a way that, in the machine direction, a working surface of the top side has a downstream end which, in the machine direction, is followed by an exit side surface that diverges from the interior surface of the flexible jacket. The press body further has at least a first and a second internal pressure chamber which internal pressure chambers can be pressurized such that the press body expands. The first internal pressure chamber has an extension in the machine direction that does not extend beyond the working surface and the second internal pressure chamber is located downstream of the first internal pressure chamber and has an extension in the machine direction beyond the downstream end of the working surface. The extended nip roll also comprises a support for the press body which support provides support to sides of the press body but allows the press body to expand in a direction towards the interior surface of the flexible jacket. The second internal pressure chamber has such an extension in the machine direction that more than 30% of the extension (the machine direction length of the second internal pressure chamber) extends beyond the downstream end of the working surface and in that the working surface and the exit side surface are made of a material that has a higher shore A hardness than the material in the rest of the press body.

The press body may be designed such that, in an unloaded state of the extended nip roll, the exit side surface downstream of the working surface forms an angle of 30°-65° with a tangent to the working surface, preferably an angle in the range of 35°-60°.

The working surface of the top side may be a flat surface in the unloaded state of the extended nip roll when the extended nip roll does not form a nip with a counter roll. Moreover, in the unloaded state of the extended nip roll, the exit side surface downstream of the working surface may form an angle of 40°-50° with the working surface. Instead of being flat in the unloaded state of the roll, the working surface may be, for example, a convex or concave surface.

In embodiments of the invention, a part of press body may comprise a sole which forms the working surface and the exit side surface. In such embodiments, the sole may preferably have a thickness in the range of 1 mm-30 mm, preferably 5 mm-25 mm, even more preferred 10 mm-25 mm.

The sole may have a Shore A hardness that is higher than 90 Shore A while the part of the press body that surrounds the internal pressure chambers has a hardness which is less than or equal to 90 Shore A (i.e. at most 90 Shore A). Preferably the sole has a hardness of 93 Shore A-100 Shore A while the part of the press body that surrounds the internal pressure chambers has a hardness of 70 Shore A-90 Shore A.

The exit side surface is preferably separated from the working surface by a rounded edge which has a first radius in an area adjacent the working surface and a second radius in an area adjacent the exit side surface and wherein the second radius is smaller than the first radius. In embodiments of the invention, the first radius is in the range of 20 mm-40 mm and the second radius is in the range of 6 mm-15 mm.

The rounded edge that separates the working surface from the exit side surface may have an extension in the machine direction which is in the range of 6 mm-16 mm.

In embodiments of the invention, the press body comprises also a third internal pressure chamber which, in the machine direction, is located upstream of the first internal pressure chamber.

Preferably, the internal pressure chambers have a rectangular shape and a larger extension in the radial direction of the extended nip roll than in the machine direction.

In embodiments of the invention, the press body comprises a lip located upstream of the working surface and which lip protrudes in an upstream direction. The lip has an entry surface that faces the interior surface of the flexible jacket and forms an angle of 2°-50° with a tangent to the working surface.

A lubrication channel may advantageously be arranged to feed a lubricant to the working surface. However, it should be understood that such a lubrication channel is optional.

Preferably, the press body may be covered by an exchangeable wear protection layer. However, it should be understood that embodiments without such a wear protection layer are conceivable.

The invention also relates to an extended nip press comprising an extended nip roll as described above and additionally comprising a counter roll cooperating with the extended nip roll. The counter roll can preferably be a roll that is arranged to be heated, e.g. a Yankee drying cylinder.

The invention also relates to a paper making machine comprising an extended nip roll as described above, a counter roll cooperating with the extended nip roll to form an extended nip press and a forming section arranged upstream of the extended nip press.

The invention also relates to a method of operating an extended nip press as described above wherein a wet paper web is passed through the extended nip and subjected to pressure as the web passes through the nip. The extended nip is operated such that the pressure rises as the web passes through the nip and reaches a peak as the web passes over the downstream end of the working surface of the press body.

DETAILED DESCRIPTION OF VARIOUS EMBODIMENTS

Figure 1:
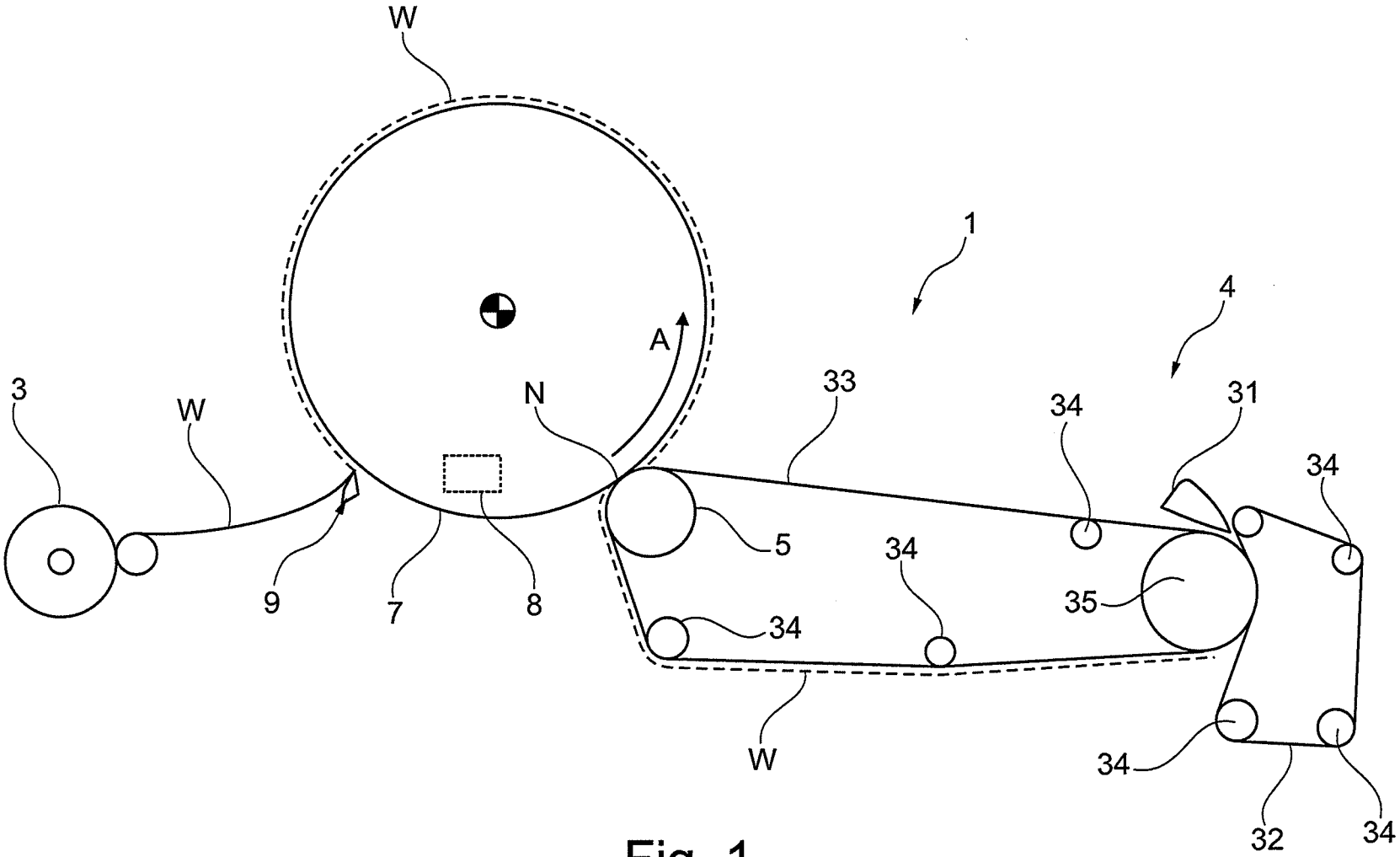
FIG. 1 is a schematic representation of a paper making machine in which the inventive extended nip roll and extended nip press may be used.

With reference to FIG. 1, a paper making machine 1 is shown which is suitable for making tissue paper, i.e. paper such as toilet paper, kitchen towel or similar grades. In many practical applications, the tissue paper produced in such a machine may have a basis weight in the range of 15 g/m$^2$-25 g/m$^2$ but tissue paper having a basis weight outside this range may also be produced. The paper making machine of FIG. 1 includes a forming section 4 in which a head box 31 is arranged to inject stock in a gap between a forming fabric 32 and a felt 33. The forming fabric 32 would typically be a foraminous wire. The felt 33 is arranged to pass over a forming roll 35 and the felt 33 and the forming fabric 32 are guided in their loops by guide rolls 34. From the forming section 4, a newly formed wet fibrous web W is transported by the felt 33 to a press nip N formed between an extended nip roll 5 and a counter roll 7. The counter roll 7 may be a Yankee drying cylinder but embodiments are conceivable in which the web W is first pressed in a press nip before the Yankee drying cylinder and subsequently passed to the Yankee drying cylinder. In the press nip N between the extended nip roll and the counter roll 7, water is pressed out of the web W and absorbed by the felt 33 which is water-receiving. The web W then passes over a Yankee drying cylinder which in the embodiment of FIG. 1 is identical to the counter roll 7 for the extended nip roll 5. In FIG. 1, it should be understood that the counter roll 7 (i.e. the Yankee drying cylinder) rotates in the direction of arrow "A". On the Yankee drying cylinder, the web is dried by heat as water that remains in the web after the nip N is evaporated by heat. The counter roll 7 may be heated by heating means that are symbolically indicated by the reference numeral 8 in FIG. 1. In practice, the heating means may be a supply of hot steam that is introduced to the interior of a Yankee drying cylinder. Inside the Yankee cylinder, the hot steam may have a temperature significantly over 100° C. and the inner wall surface of the Yankee cylinder may reach temperatures on the order of about 180° C. The temperature on the exterior surface of the Yankee cylinder is significantly lower where the Yankee surface is covered by the web W since much of the heat is consumed when water in the wet web W is evaporated. In a papermaking machine for tissue paper, the temperature of the exterior Yankee surface below the wet web W may normally be in the range of 95° C.-100° C. but both higher and lower surface temperatures can be used depending on the operating conditions and requirements of each specific application. In some cases, surface temperatures of up to 140° C. may be considered. In principle, the heating means 8 could be something else than hot steam. For example, the heating means could be an inductive heater located either inside or outside the counter roll 7. The dry solids content of the web as it reaches the press nip may vary considerably but in many realistic cases, the dry solids content may be on the order of 18%-22% when the web W reaches the nip N. After the nip N, the web W may have a dry solids content of 40%-55% depending on such factors as, for example, linear load in the nip, the temperature of the counter roll and dry solids content of the web W before the web W reaches the nip N. The web W is typically doctored from the Yankee drying cylinder by means of a doctor 9. The ready-dried web W is then passed to a reel-up 3. It should be understood that what has been explained above with reference to FIG. 1 may be applicable to all embodiments of the present invention.

Figure 2:
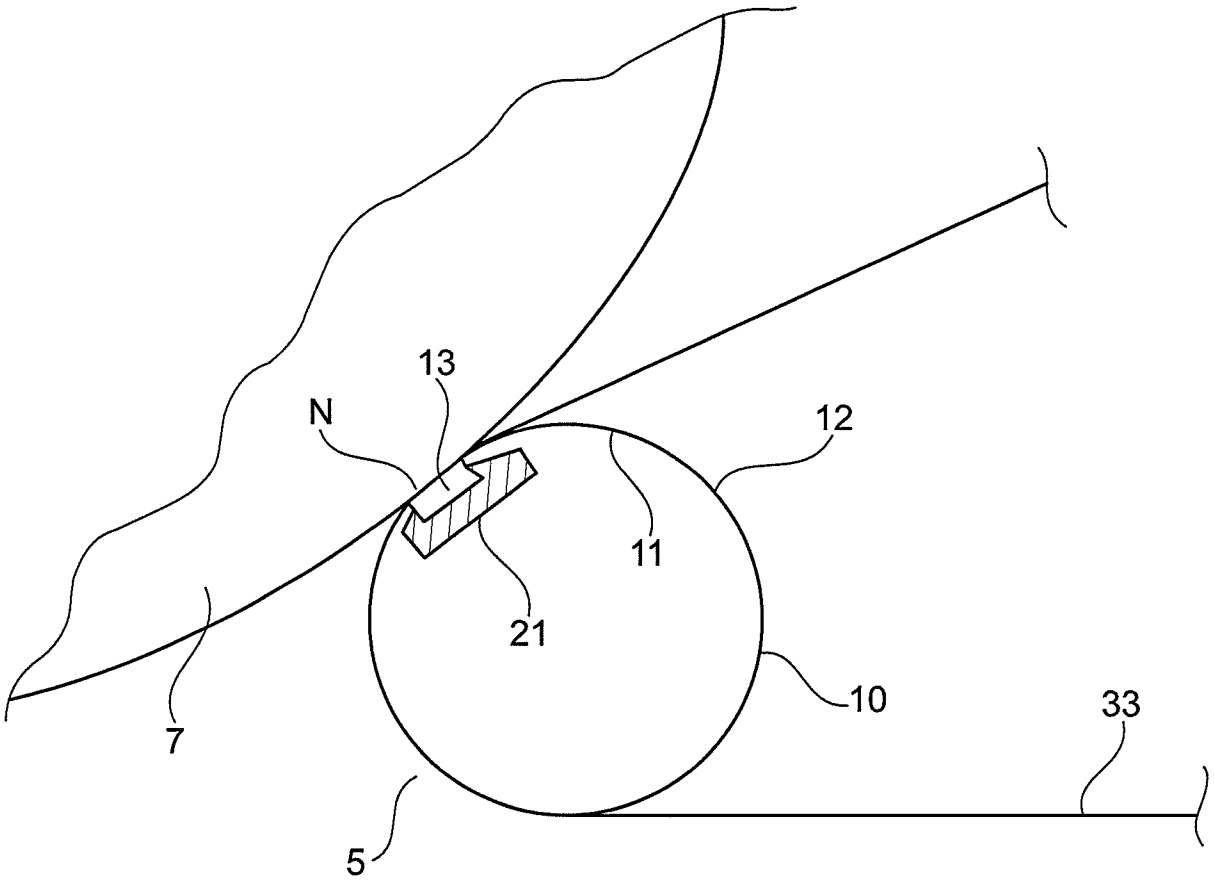
FIG. 2 is a schematic cross sectional view of an extended nip press according to the invention.

With reference to FIG. 2, it can be seen that the press nip N is formed between an extended nip roll 5 and the counter roll 7. It should be understood that the extended nip roll 5 can be moved away from the counter roll 7 such that the nip N is opened. The press nip N has an extension in the machine direction when the extended nip roll 5 cooperates with the counter roll 7.

The extended nip roll 5 comprises a flexible jacket 10 with an interior surface 11 and an exterior surface 12. The flexible jacket 10 is typically made of polyurethane or comprises polyurethane. The flexible jacket 10 is shaped as a tube that extends in a cross machine direction. At its axial ends, it is normally connected to end walls that can rotate about an axis. Such arrangements are well known in the art of paper machinery and examples of fastenings for the axial ends of the flexible jacket are disclosed in, for example, U.S. Pat. No. 5,904,813 and European patent No. 1273701. The flexible jacket 10 may thus define an enclosed space. Advantageously, the extended nip roll 5 may be connected to a source of pressurized air such that the enclosed space within the flexible jacket 10 may be filled with pressurized air. Such an arrangement helps keeping the shape of the flexible jacket.

Figure 5:
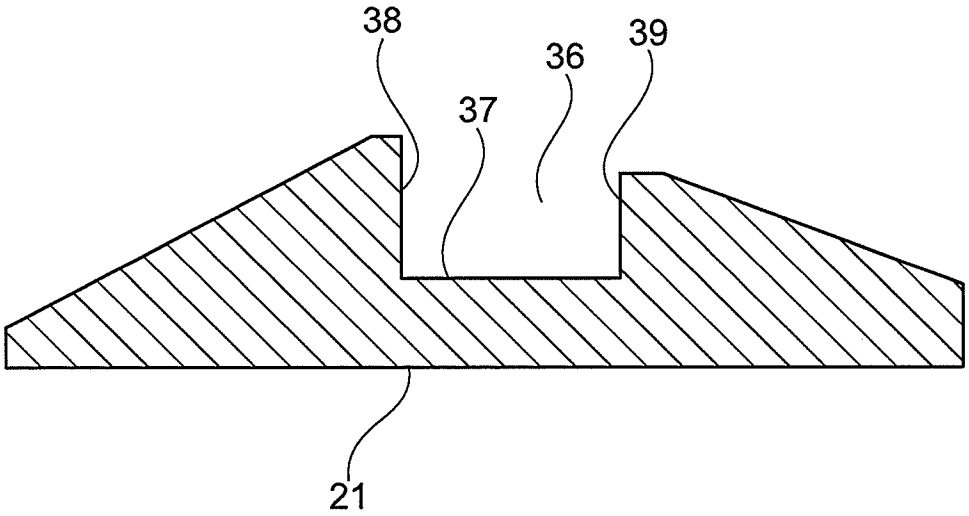
FIG. 5 is a cross sectional view of a support for a press body used in an extended nip roll according to the invention.
Figure 6:
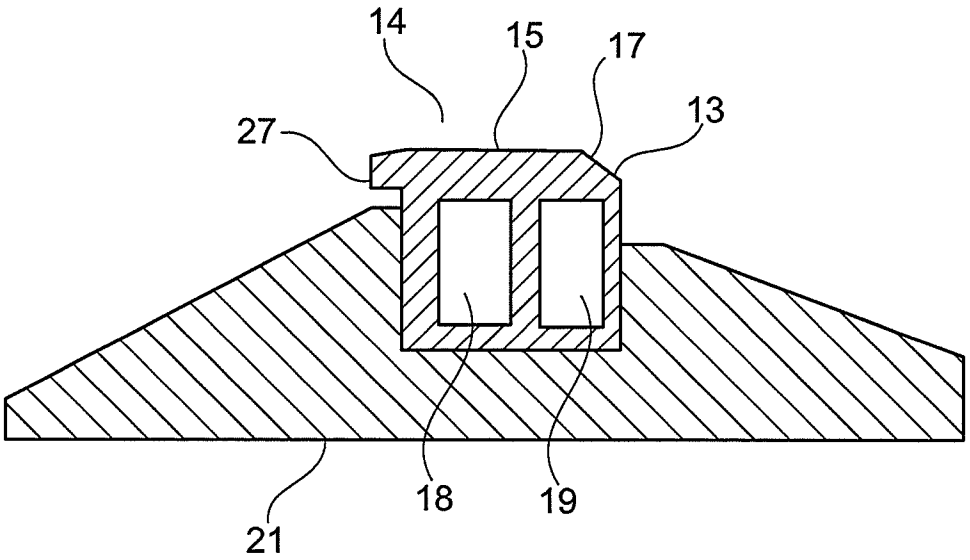
FIG. 6 is a cross sectional view of a press body according to the invention placed in a support.

A press body 13 is arranged inside the flexible jacket 10. The press body 13 is elastically deformable and has a top side 14 that faces the interior surface 11 of the flexible jacket 10 (see also FIG. 6 and FIG. 10). The press body 13 is placed in a support 21 for the press body 13. The support 21 provides support to sides of the press body 13 but allows the press body 13 to expand in a direction towards the interior surface 11 of the flexible jacket 10. With reference to FIG. 5, the support 21 has a groove 36 in which the press body 13 may be placed. The groove 36 has a bottom wall 37, an upstream wall 38 and a downstream wall 39. In FIG. 6, it can be seen how the press body 13 has been placed in the groove 36 of the support 21. The press body 13 can be connected to a source of pressurized fluid in the same way as disclosed in U.S. Pat. No. 7,527,708. As described in U.S. Pat. No. 7,527,708, the press body 13 can be sealed (for example at its axial ends) and connected to a pressure medium source. The pressure medium may be, for example, hydraulic oil. The press body 13 has at least a first and a second internal pressure chamber 18, 19 as can be seen in FIG. 6, FIG. 7, FIG. 8 and FIG. 11. In embodiments of the invention, the press body 13 may optionally have a third internal press chamber 20 as can be seen in for example FIG. 7. The press body 13 may optionally also have more than three internal pressure chambers and embodiments with four, five, six or even more internal pressure chambers are conceivable. When the press body 13 is connected to a source of pressurized medium, the pressurized medium can be used to fill the internal chambers 18, 19, 20. When the internal chambers 18, 19, 20 are sealed (for example at the axial ends of the press body 13), the internal chambers 18, 19, 20 will become pressurized when they are filled with pressurized fluid.

It should be understood that the support 21 is in a fixed position and does not move during operation of the extended nip press. It may be supported by a support beam (not shown) that may carry rotatable end walls to which the axial ends of the flexible jacket 10 are fixed as is known in the art and as explained above. When the internal pressure chambers 18, 19, 20 are pressurized, the press body 13 will expand. The bottom wall 37 and the upstream and downstream walls 38, 39 of the support 21 prevent or limit expansion in the direction of those walls and the support 21 likewise has walls at its axial ends (not shown) that prevent or limit expansion in the axial direction. However, the top side 14 of the press body 13 is not limited by any wall of the support 21. At its top side 14, the press body 13 is therefore free to expand in a direction towards the internal surface 11 of the flexible jacket 10 when the internal pressure chambers are pressurized. When the internal pressure chambers 18, 19, 20 are pressurized, the press body 13 will therefore expand. It should be understood that, when the extended nip roll 5 is used, it is typically so that the press nip N is closed when the press body 13 is caused to expand due to pressure in the internal pressure chambers 18, 19, 20.

In an extended nip press, the pressure profile should be unsymmetrical in such a way that the peak pressure is achieved shortly before the end of the press nip whereafter the pressure is quickly reduced. Such a pressure profile reduces re-wetting of the paper web. It is also desirable that the pressure gradient at the beginning of the nip is relatively small such that the pressure initially is increased gently. Thereafter, the pressure should increase progressively until it reaches a peak at the end of the nip.

Figure 3:
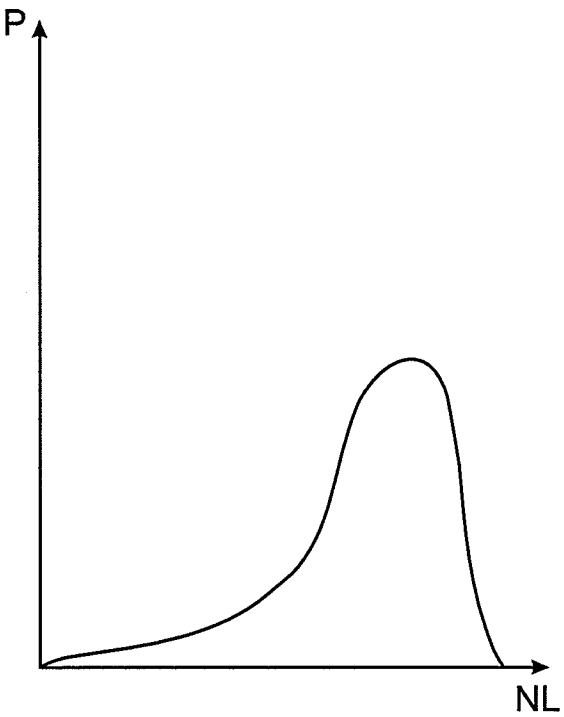
FIG. 3 shows a desired pressure profile in an extended nip.

With reference to FIG. 3, a desirable pressure profile is illustrated. In FIG. 3, the horizontal axis (NL) represents nip length while the vertical axis (P) represents pressure. As can be seen in FIG. 3, the nip pressure increases progressively with a small pressure gradient in the beginning of the nip and a steeper rise in pressure towards the end of the nip. When the pressure rises gently in the beginning of the nip, the risk of web breaks becomes smaller.

According to one aspect of the invention, the press body 13 is designed in such a way as to assist in producing a pressure profile where the peak pressure appears at the end of the nip. To achieve this purpose, the press body is designed in the following way. With reference to FIG. 6, FIG. 7, FIG. 8, FIG. 9 and FIG. 10, the top side 14 of the press body 13 is beveled in such a way that, in the machine direction, a working surface 15 of the top side has a downstream end 16 which, in the machine direction, is followed by an exit side surface 17 that diverges away from the interior surface 11 of the flexible jacket 10. The working surface 15 is that part of the top side 14 that is intended to act against the counter roll 7 to form the actual nip N.

Figure 7:
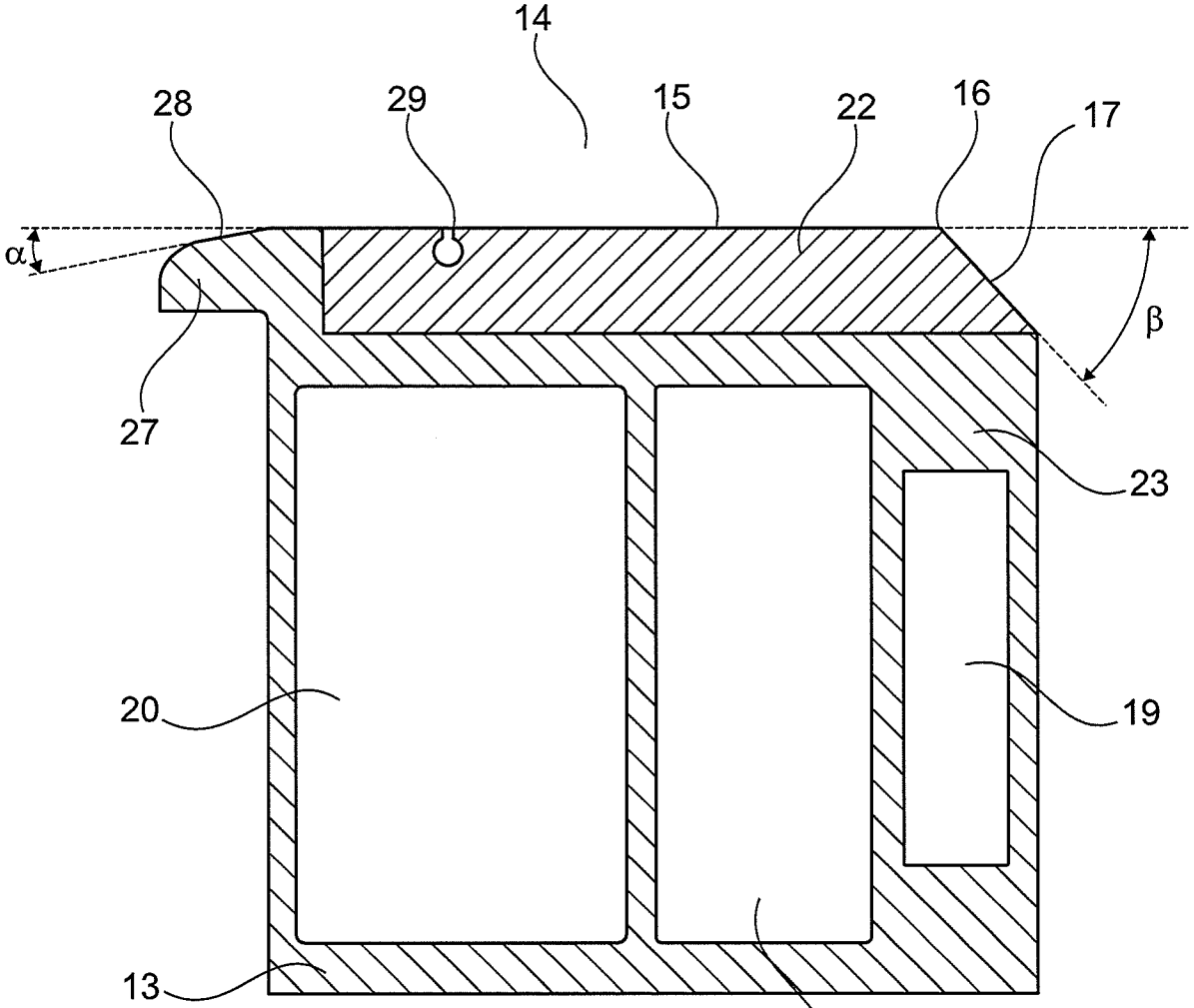
FIG. 7 is a cross sectional view showing in greater detail an embodiment of a press body for an extended nip roll according to the present invention.
Figure 8:
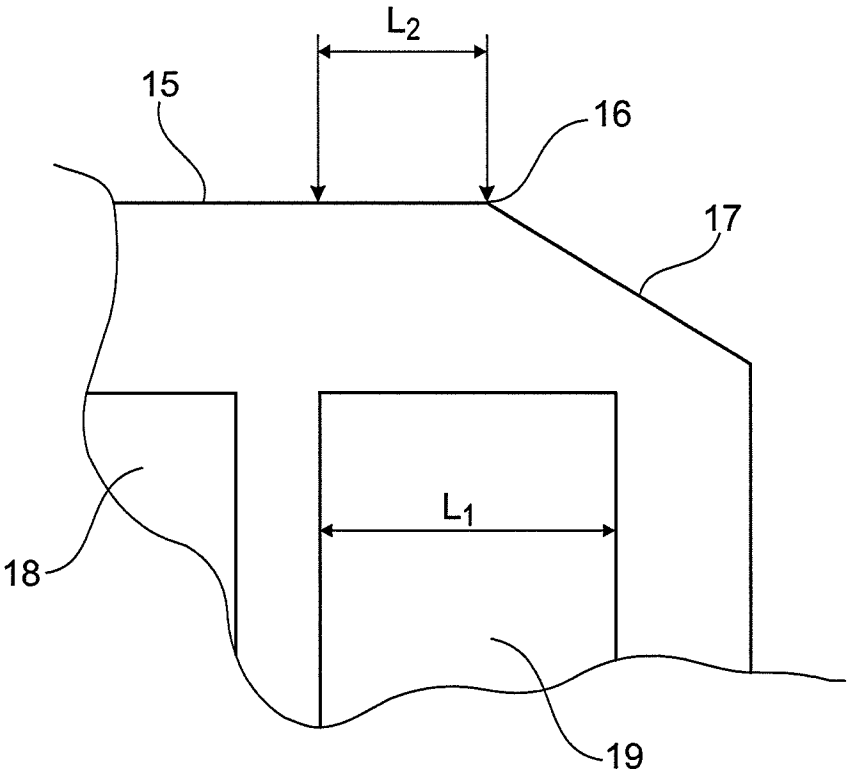
FIG. 8 is a cross sectional view illustrating a part of a press body according to an embodiment of the invention.

As best seen in FIG. 7, the first internal pressure chamber 18 has an extension in the machine direction that does not extend beyond the working surface 15. This means that the force generated in the first internal pressure chamber is distributed over a part of the working surface which is not shorter in the machine direction than the first internal pressure chamber itself. The pressure will therefore be distributed relatively evenly over that part of the working surface 15. However, the pressure distribution will not be entirely even since the pressure distribution is also influenced by other factors, for example by the pressure upstream and downstream of the first internal pressure chamber 18. With reference to FIG. 8, the second internal pressure chamber 19 is located downstream of the first internal pressure chamber 18. As can be seen in FIG. 8, the second internal pressure chamber 19 has an extension $L_1$ in the machine direction. As can also be seen in FIG. 8, the second internal pressure chamber 19 extends in the machine direction beyond the beyond the downstream end 16 of the working surface 15 while a part of the second external pressure chamber 19 extends below a part of the working surface 15 that is located upstream of the downstream end 16 of the working surface 15. The part of the working surface 15 that is located above the second internal pressure chamber 19 has an extension $L_2$ on the machine direction which is less than the extension $L_1$ of the second internal pressure chamber 19. Therefore, the force generated by the pressure in the second internal pressure chamber 19 will be distributed over a surface that is smaller than the effective area of the second internal pressure chamber 19. Consequently, the pressure on that part of the working surface 15 on which the second internal pressure chamber acts will be higher than the pressure in the second internal pressure chamber 19, the pressure is "geared up". In this way, a pressure peak is obtained in the area immediately before the end of the press nip N. This pressure peak can be obtained even if the pressure in the second internal pressure chamber is the same as or even somewhat lower than the pressure in the first internal pressure chamber 18. The inventors have found that the second internal pressure chamber 19 should have such an extension $L_1$ in the machine direction that more than 30% of the extension (the machine direction length L1 of the second internal pressure chamber 19) extends beyond the downstream end 16 of the working surface 15, i.e. $L_2<0.70\ L_1$. Preferably the second internal pressure chamber 19 has such an extension in the machine direction that more than 40% of the extension (machine direction length of the second internal pressure chamber) extends beyond the downstream end 16 of the working surface 15. Preferably, not more than 90% of the extension should extend beyond the downstream end 16. Even more preferred, not more than 70% of the extension $L_1$ should extend beyond the downstream end 16. In many realistic embodiments, 40%-60% of the extension $L_1$ goes beyond the downstream end 16 of the working surface 15. For example, 45%-50% of the extension L1 of the second internal pressure chamber 19 may go beyond the downstream end 16 of the working surface 15.

Figure 4:
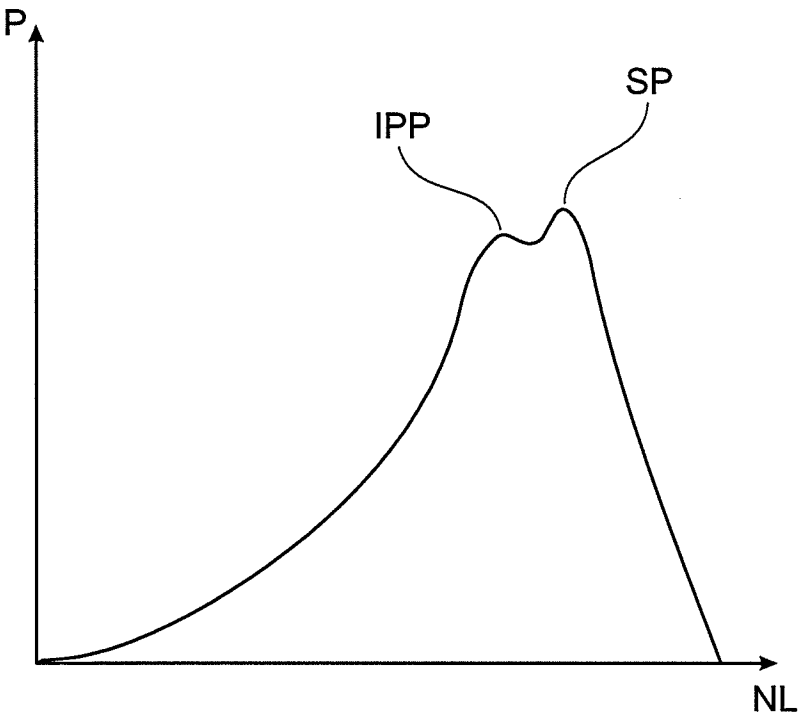
FIG. 4 shows a possible actual pressure profile in an extended nip.

The inventors have found that, when the press body 13 is made of an elastic material, this has many advantages. One advantage is that the elasticity of the press body makes it possible to expand the press body by means of pressurized fluid. Another advantage is that the press body can adapt very accurately to the profile of the counter roll such that a regular pressure distribution can be obtained. However, the inventors have found that the elasticity of the press body 13 can also result in a problem that is related precisely to the pressure distribution. With reference to FIG. 4, the inventors have found that, at the end of the press nip and after the intended peak point IPP, the pressure can rise again such that a second peak SP results (see FIG. 4). Such a second peak or "return-peak" is harmful because it counteracts lubrication at the area of the peaks. If the unintended second peak is too high, that may also cause damage to the web. The inventors have found that the reason for the second peak is that, when the elastic material in the press body 13 is too soft, a part of the press body downstream of the actual working surface may deform to such an extent that it actually meets the flexible jacket 10 and presses the external surface 12 of the flexible jacket 10 against the counter roll thereby causing a second peak.

The inventors have found that the second peak can be prevented or reduced if the working surface 15 and the exit side surface 17 are made of a material that has a higher shore A hardness than the material in the rest of the press body 13.

With reference to FIG. 7, at least a part of the top side 14 can be made of a harder material than the rest of the press body 13. In the embodiment of FIG. 7, the part of the press body 13 that forms the working surface 15 and the exit side surface 17 is a sole 22. The sole 22 can be made in a harder material while the rest of the press body is a softer part 23. The sole 22 has a higher Shore A hardness than the part 23 in which the internal pressure chambers 18, 19, 20 are formed. The sole 22 may suitably have a thickness in the range of 1 mm-30 mm, preferably 5 mm-25 mm, even more preferred 10 mm-25 mm. The sole should not be thinner than 1 mm since it could then become too flexible which would increase the risk of a second peak. If it were too thick, the ability of the sole 22 to adapt its shape to that of the counter roll could be reduced which would be undesirable.

Preferably, the sole 22 has a hardness higher than 90 Shore A while the softer part 23 of the press body 13 that surrounds the internal pressure chambers 18, 19, 20 has a hardness which is less than or equal to 90 Shore A, preferably the sole has a hardness of 93 Shore A-100 Shore A while the softer part 23 of the press body that surrounds internal pressure chambers 18, 19, 20 has a hardness of 70 Shore A-90 Shore A. In one realistic embodiment considered by the inventors, the sole 22 may have a shore A hardness of 95 while the softer part 23 that surrounds the internal pressure chambers 18, 19, 20 may have a shore A hardness of 90. This means that the softer part 23 of the press body 13 that surrounds the internal pressure chambers 18, 19, 20 is sufficiently soft to deform and expand in response to increased pressure in the internal pressure chambers 18, 19, 20. At the same time, the sole 22 has such a hardness that it will not easily deform to cause a second peak.

In an unloaded state of the extended nip roll 5, the exit side surface 17 downstream of the working surface 15 preferably forms an angle β of 30°-65° with a tangent to the working surface 15, preferably an angle β in the range of 35°-60° (see FIG. 7). In many realistic embodiments, the working surface 15 of the top side 14 is a flat surface in the unloaded state of the extended nip roll 5 when the extended nip roll 5 does not form a nip with a counter roll 7. In such embodiments the exit side surface 17 downstream of the working surface 15 may, in the unloaded state of the extended nip roll 5, form an angle β of 40°-50° with the working surface 15. When the exit side surface 17 forms an angle β of 30°-65° with the working surface (or with a tangent to the working surface if the working surface is not a flat surface in the unloaded state of the extended nip roll), the exit side surface 17 diverges to such an extent from the nip and the flexible jacket 10 that the risk of a second peak is reduced. At the same time, there is material downstream of the working surface 15 that can contribute to support the press body 13 in the nip N.

To further reduce the risk that a second peak occurs, the inventors have found that the area in which the working surface 15 goes over into the exit side surface 17 should preferably be shaped in a way that counteracts any tendency of the press body 13 to deform such that a second peak occurs.

Figure 9:
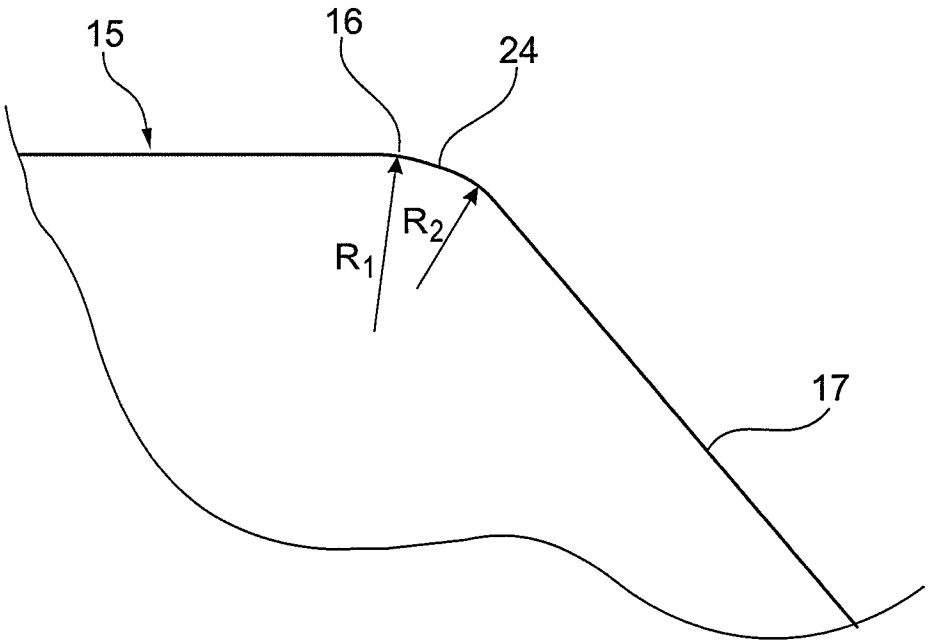
FIG. 9 is a cross sectional view similar to FIG. 9 but illustrating in greater detail a part of the press body according to the invention.
Figure 10:
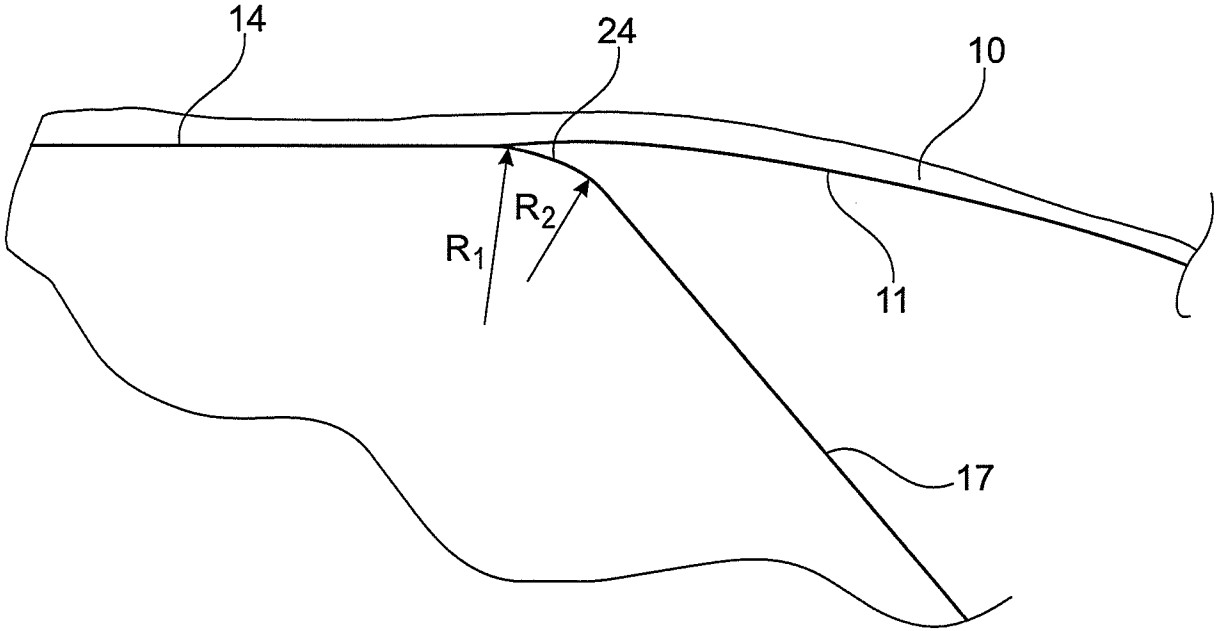
FIG. 10 is a cross sectional view similar to FIG. 9 but including a part of the flexible jacket.

With reference to FIG. 9 and to FIG. 10, the exit side surface 17 is separated from the working surface 15 by a rounded edge 24 which has a first radius $R_1$ in an area adjacent the working surface 15 and a second radius $R_2$ in an area adjacent the exit side surface 17. According to one advantageous embodiment of the invention, the second radius $R_2$ is smaller than the first radius $R_1$. Thereby, the rounded edge 24 first gently turns away from the nip and then more abruptly. Such a shape of the rounded edge 24 further reduces the risk of a second peak ("return peak"). In many realistic embodiments of the invention, the first radius $R_1$ may be in the range of 20 mm-40 mm while the second radius $R_2$ may be in the range of 6 mm-15 mm. The rounded edge 24 is thus divided into a first zone with a larger radius $R_1$ and a second zone with a smaller radius $R_2$. In the machine direction, the rounded edge may have a total length which is in the range of 6 mm-16 mm.

With reference to FIG. 7, embodiments are conceivable in which the press body 13 comprises also a third internal pressure chamber 20 which, in the machine direction, is located upstream of the first internal pressure chamber 18. Embodiments are also conceivable in which there are more than three internal pressure chambers. The use of several internal pressure chambers 18, 19, 20, makes it easier to produce a rising pressure profile since different pressures can be used in different pressure chambers 18, 19, 20.

The internal pressure chambers 18, 19, 20 preferably have a rectangular shape and a larger extension in the radial direction of the extended nip roll 5 than in the machine direction.

Another aspect of the invention will now be explained with reference to FIG. 6 and to FIG. 7. In embodiments of the invention, the press body 13 optionally comprises a lip 27 located upstream of the working surface 15. The lip 27 protrudes in an upstream direction and has an entry surface 28 that faces the interior surface 11 of the flexible jacket 10 (it should be understood that, while the flexible jacket 10 is not shown in FIG. 6 and FIG. 7, it does in fact enclose the press body 13 and is arranged to run over the press body 13 during operation). The entry surface 28 forms an angle $\alpha$ of 2°-50° with a tangent to the working surface 15. Preferably, it forms an angle $\alpha$ of about 5°-15° with a tangent to the working surface 15 or to the working surface itself when the working surface 15 is flat in the unloaded state of the extended nip roll. In one embodiment considered by the inventors, the entry surface 28 forms an angle $\alpha$ of 10° with the working surface which may then be flat in the unloaded state of the extended nip roll. By using a lip that protrudes rearwards from the working surface and beyond the area of the top side 14 that can be acted upon by any of the internal pressure chambers 18, 19, 20, the pressure in the nip N can be given a gentle start, especially when the entry surface 28 forms an angle with the working surface 15. In that way, the lip 27 contributes to giving a smooth start to the pressure curve.

Preferably, a lubrication channel 29 is arranged to feed a lubricant to the working surface 15. In the embodiment that is shown in FIG. 7, the lubrication channel 29 is located in the sole 22 but the lubrication channel 29 could also be located upstream of the point where the sole 22 begins. It should be understood that the extended nip roll may also comprise additional means for supplying a lubricant. For example, a lubricant such as oil may be fed to the interior surface 11 of the flexible jacket 10 at a location away from the nip, for example immediately before the flexible jacket 10 reaches the nip N. It should also be understood that the extended nip roll 5 may be provided with means for evacuating such lubricant that has already been used.

Although not shown in the figures, it should be understood that the inventive extended nip roll may also be provided with an evacuation system for removing such lubricant fluid that has already been used such that spent lubricant fluid may be continuously replaced by fresh lubricant fluid (e.g. oil).

Figure 11:
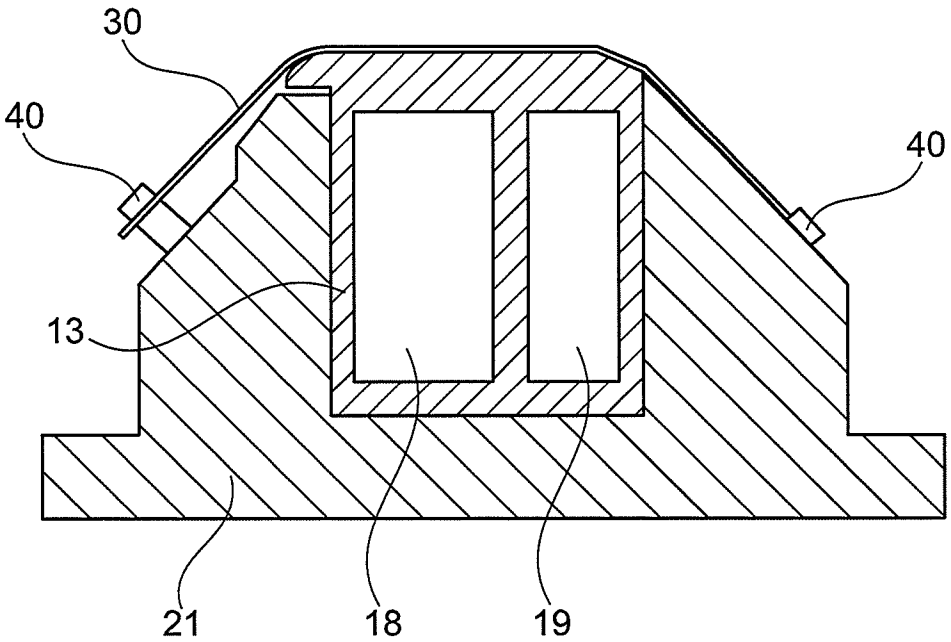
FIG. 11 is a cross sectional view that illustrates how an exchangeable wear protection layer can be placed over the press body.

With reference to FIG. 11, yet another feature shall be explained. Optionally, the press body 13 is may be covered by an exchangeable wear protection layer 30 that can be secured to the support upstream and downstream of the press body 13. The wear protection layer 30 may be detachably secured to the support 21 by means of elements 40 such as screws or bolts or other suitable fastening elements. The wear protection layer 30 can be, for example, a Thordon sheet.

In operation, a web W is formed in the forming section and passed to the extended nip press formed between the extended nip roll 5 and the counter roll 7 and subjected to pressure as the web W passes through the nip N. The pressure will rise as the web W passes through the nip N and reach a peak as the web passes over the downstream end of the working surface 15 of the press body 13.

When the press body 13 has two internal pressure chambers 18, 19, the hydraulic pressure in the first internal pressure chamber 18 may be about 0.16 MPa during operation of the extended nip press while pressure in the second internal pressure chamber 19 may be about 3.2 MPa. The peak pressure may then be on the order of about 6.5 MPa. In another embodiment, pressure in the first chamber 18 may be about 0.9 MPa while pressure in the second internal pressure chamber 19 may be about 2.6 MPa and the peak pressure about 6 MPa. Depending on the shape of the press body 13 and the pressure in the second internal pressure chamber 19, peak pressure may be significantly higher than 6.5 MPa. Due to the design of the press body, the peak pressure is thus clearly higher than the actual pressure in the second internal pressure chamber 19. Generally speaking, a suitable pressure level in the first internal pressure chamber 18 during operation may, in many embodiments, be 0.1 MPa-0.6 MPa while the pressure in the second internal pressure chamber 19 may be in the range of 1.5 MPa-5 MPa in many practical embodiments.

It should be understood that the actual peak pressure (the highest pressure acting on the web W in the nip N) achieved may vary depending on, for example, the pressure in the internal pressure chambers and the shape of the press body. In many embodiments, the actual peak pressure achieved in the nip N may be in the range of, for example, 1.6 MPa-6.5 MPa. However, both lower and higher peak pressures are conceivable.

In many realistic embodiments of the invention, the nip length may be in the range of, for example, 80 mm-150 mm although other dimensions are also conceivable. The nip length is dependent on the length of the working surface 15 of the press body 13. In one realistic embodiment that has been contemplated, nip length may be 130 mm.

The dimensions of the extended nip roll 5 may of course vary. However, in many realistic embodiments, it may have a diameter in the range of, for example, 800 mm-1500 mm. For example, it may have a diameter of 1100 mm.

In practice, the machine in which the inventive extended nip roll is used may be operated at a speed in the range of, for example, 800 m/minute-1800 m/minute.

Speeds higher than 1800 m/minute may also be contemplated. Generally speaking, higher speeds are usually desirable since higher speeds normally mean higher productivity. However, a higher machine speed may entail certain difficulties. For example, a higher machine speed means a shorter dwell time in the nip N. A shorter dwell time in the nip N may have the result that less water is pressed out of the web. It has been noted that, in an application where the counter roll 7 was a hot Yankee cylinder and where the linear load was 150 kN/m, the dryness level after the nip N decreased by 1% when the machine speed was increased from 1500 m/minute to 1800 m/minute.

It can be added that, when the pressing of tissue paper takes place at a low temperature, for example when the counter roll 7 is at room temperature (about 10° C.-30° C.), trials have indicated that the dewatering is less influenced by machine speed. However, when the temperature in the nip is high (as when the counter roll is a hot Yankee cylinder), dwell time in the nip makes a significant difference for the dewatering effect on a tissue web. Dewatering is also more effective when the nip N is formed against a hot counter roll such as a Yankee cylinder.

In principle, the extended nip roll 5 may be pressurized already when the papermaking machine is started and the nip N may be closed. However, the extended nip roll 5 is normally not pressurized when the papermaking machine is started—or at least not fully pressurized. Instead, the nip N may actually be open when the papermaking machine is started. When the machine has reached a certain speed, for example a speed in the range of 550 m/minute-650 m/minute, the nip N may be closed and the internal pressure chambers may be pressurized. Preferably, the entire extended nip roll 5 may be movable towards and away from the counter roll 7 (which may be a Yankee cylinder). The starting sequence may then be that the extended nip roll 5 is moved close to the counter roll 7 when the machine has reached a certain speed (for example 600 m/minute). When the extended nip roll 5 has reached a position close to the counter roll 7, the internal pressure chambers may be pressurized such that the press body 13 is caused to expand radially outwards. When the press body 13 expands, the flexible jacket 10 will be pressed towards the counter roll 7 and the nip N will be closed. When it has been established that the nip N is closed, the load can be increased by increased pressure in the internal pressure chambers. Alternatively, the internal pressure chambers may be lightly pressurized while the extended nip roll 5 is moved towards the counter roll 7 until the nip N has been closed. When it has been established that the nip N is closed, the load can be increased by increased pressure in the internal pressure chambers.

If it is desired to produce a product with high bulk, the pressure profile can be altered such that the pressure in the last internal pressure chamber is decreased (the last internal pressure chamber is the second internal pressure chamber 19 since this is the last internal pressure chamber in the machine direction). Such a profile may increase bulk but dewatering becomes less effective. If instead the energy consumption should be kept low, an effective dewatering in the nip N is desirable. If effective dewatering is desired, the pressure in the last internal pressure chamber (i.e. the second internal pressure chamber 19) should be higher. It is generally known that bulk decreases with increased nip load.

It should be understood that, in the context of this application, the machine direction is the direction in which the web moves from the forming section to the reel-up.

Although the invention has been described above in terms of an extended nip roll, an extended nip press, a paper making machine and a method of operating an extended nip press, it should be understood that these categories only reflect different aspects of one and the same invention. The inventive extended nip roll can thus be used in the inventive extended nip press and the inventive extended nip press is used in the inventive machine and the inventive method.

The invention claimed is:

1. An extended nip roll (5) capable of forming a press nip (N) with a counter roll (7) which press nip (N) has an extension in a machine direction when the extended nip roll (5) cooperates with the counter roll (7), the extended nip roll (5) comprising;

a flexible jacket (10) with an interior surface (11) and an exterior surface (12);

a press body (13) arranged inside the flexible jacket (10), the press body (13) being elastically deformable and having a top side (14) that faces the interior surface (11) of the flexible jacket (10), the top side (14) of the press body (13) being beveled in such a way that, in the machine direction, a working surface (15) of the top side has a downstream end (16) which, in the machine direction, is followed by an exit side surface (17) that diverges from the interior surface (11) of the flexible jacket (10), the press body (13) further having at least a first and a second internal pressure chamber (18, 19) which internal pressure chambers (18, 19) can be pressurized such that the press body (13) expands, the first internal pressure (18) chamber having an extension in the machine direction that does not extend beyond the working surface (15) and the second internal pressure chamber (19) being located downstream of the first internal pressure chamber (18) and having an extension in the machine direction beyond the downstream end (16) of the working surface (15); and a support (21) for the press body (13) which support (21) provides support to sides of the press body (13) but allows the press body (13) to expand in a direction towards the interior surface (11) of the flexible jacket (10), wherein:

the second internal pressure chamber (19) has such an extension in the machine direction that more than 30% of the extension extends beyond the downstream end (16) of the working surface (15); and the working surface (15) and the exit side surface (17) are made of a material that has a higher shore A hardness than the material in the rest of the press body (13).

2. An extended nip roll according to claim 1, wherein, in an unloaded state of the extended nip roll (5), the exit side surface (17) downstream of the working surface (15) forms an angle of 30°-65° with a tangent to the working surface (15).

3. An extended nip roll according to claim 2, wherein said angle is in the range of 35°-60°.

4. An extended nip roll according to claim 1, wherein:

the working surface (15) of the top side (14) is a flat surface in the unloaded state of the extended nip roll (5) when the extended nip roll (5) does not form a nip with a counter roll (7); and in the unloaded state of the extended nip roll (5), the exit side surface (17) downstream of the working surface (15) forms an angle of 40°-50° with the working surface (15).

5. An extended nip roll according to claim 1, wherein a part of press body (13) comprises a sole (22) which forms the working surface (15) and the exit side surface (17) and which sole (22) has a thickness in the range of 1 mm-30 mm.

6. An extended nip roll according to claim 5, wherein the sole (22) has a hardness higher than 90 Shore A while the part of the press body (13) that surrounds the internal pressure chambers (18, 19, 20) has a hardness which is less than or equal to 90 Shore A.

7. An extended nip roll according to claim 6, wherein:

the hardness of the sole is in a range of 93 Shore A-100 Shore A; and the hardness of the press body is in a range of 70 Shore A-90 Shore A.

8. An extended nip roll according to claim 5, wherein the thickness is in the range of 5 mm-25 mm.

9. An extended nip roll according to claim 6, wherein the thickness is in the range of 10 mm-25 mm.

10. An extended nip roll according to claim 1, wherein:

the exit side surface (17) is separated from the working surface (15) by a rounded edge (24) which has a first radius in an area adjacent the working surface (15) and a second radius in an area adjacent the exit side surface (17); and the second radius is smaller than the first radius.

11. An extended nip roll according to claim 10, wherein the first radius is in the range of 20 mm-40 mm and the second radius is in the range of 6 mm-15 mm.

12. An extended nip roll according to claim 10, wherein the rounded edge (24) that separates the working surface (15) from the exit side surface (17) has an extension in the machine direction which is in the range of 6 mm-16 mm.

13. An extended nip roll according to claim 1, wherein the press body comprises also a third internal pressure chamber (20) which, in the machine direction, is located upstream of the first internal pressure chamber (18).

14. An extended nip roll according to claim 1, wherein the internal pressure chambers (18, 19, 20) have a rectangular shape and a larger extension in the radial direction of the extended nip roll (5) than in the machine direction.

15. An extended nip roll according to claim 1, wherein:

the press body (13) comprises a lip (27) located upstream of the working surface (15) which lip (27) protrudes in an upstream direction, the lip (27) having an entry surface (28) that faces the interior surface (11) of the flexible jacket (10) and forms an angle of 2°-50° with a tangent to the working surface (15); and a lubrication channel (29) is arranged to feed a lubricant to the working surface (15).

16. An extended nip roll according to claim 1, wherein the press body (13) is covered by an exchangeable wear protection layer (30).

17. An extended nip press (2) comprising an extended nip roll according to claim 1 and a counter roll (7) cooperating with the extended nip roll (5), the counter roll (7) being a roll that is arranged to be heated, e.g. a Yankee drying cylinder.

18. An extended nip press (2) comprising an extended nip roll according to claim 1 and a counter roll (7) cooperating with the extended nip roll (5), the counter roll (7) being a Yankee drying cylinder.

19. A paper making machine comprising an extended nip roll (5) according to claim 1, a counter roll (7) cooperating with the extended nip roll (5) to form an extended nip press (2) and a forming section (4) arranged upstream of the extended nip press (2).

20. A method of operating an extended nip press (2) according to claim 17, wherein a wet paper web (W) is passed through the extended nip press and subjected to pressure as the web passes through the nip (N) of the extended nip press (2) and in which the pressure rises as the web passes through the nip (N) and reaches a peak as the web passes over the downstream end of the working surface (15) of the press body (13).

* * * * *